US010471978B2

(12) United States Patent
Fries et al.

(10) Patent No.: US 10,471,978 B2
(45) Date of Patent: Nov. 12, 2019

(54) SYSTEM AND METHOD FOR CONTROLLING A LEVEL CROSSING

(71) Applicant: ALSTOM TRANSPORT TECHNOLOGIES, Saint-Ouen (FR)

(72) Inventors: Jeffrey Fries, Grain Valley, MO (US); William Shields, Grain Valley, MO (US)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 0 days.

(21) Appl. No.: 15/904,992

(22) Filed: Feb. 26, 2018

(65) Prior Publication Data

US 2018/0273069 A1 Sep. 27, 2018

Related U.S. Application Data

(63) Continuation-in-part of application No. 15/466,071, filed on Mar. 22, 2017.

(51) Int. Cl.

| | |
|---|---|
| ***B61L 29/22*** | (2006.01) |
| ***G08C 17/02*** | (2006.01) |
| ***B61L 25/02*** | (2006.01) |
| ***B61L 29/32*** | (2006.01) |
| ***B61L 23/04*** | (2006.01) |
| ***B61L 29/30*** | (2006.01) |
| ***B61L 29/28*** | (2006.01) |

(52) U.S. Cl.

CPC ..... *B61L 29/22* (2013.01); *B61L 23/041* (2013.01); *B61L 25/026* (2013.01); *B61L 29/30* (2013.01); *B61L 29/32* (2013.01); *G08C 17/02* (2013.01); *B61L 29/28* (2013.01); *G08C 2201/91* (2013.01)

(58) Field of Classification Search

CPC ..... B61L 23/005; B61L 23/041; B61L 29/22; B61L 29/226; B61L 29/28; B61L 29/30

See application file for complete search history.

(56) References Cited

U.S. PATENT DOCUMENTS

| | | | | |
|---|---|---|---|---|
| 6,340,139 | B1 * | 1/2002 | Hilleary | B61L 29/08 246/125 |
| 6,933,858 | B2 * | 8/2005 | Pieralli | B61L 29/30 246/292 |
| 7,439,876 | B2 * | 10/2008 | Pieralli | G01S 13/04 246/292 |

(Continued)

*Primary Examiner* — Jason C Smith

(74) *Attorney, Agent, or Firm* — Troutman Sanders LLP

(57) ABSTRACT

Controlling a level crossing includes one or more transceivers located in proximity of a level crossing area on a first side of a railway track; corresponding passive reflective targets located in proximity of the level crossing area on a second side of the railway track opposite to the first side where each transceiver is located and a control unit connected to each transceiver. Each target is arranged to receive RF signals coming from each transceiver and to send back corresponding reflected signals. Each transceiver is arranged to elaborate said reflected signals to calculate predetermined parameters values. Also, the control unit is arranged to acquire said parameters values from each transceiver and to elaborate them to detect the presence of a train in an area around the level crossing area and, in case of presence of said train, to send a warning message and/or close bars of the level crossing.

15 Claims, 2 Drawing Sheets

(56) References Cited

U.S. PATENT DOCUMENTS

| | | | | |
|---|---|---|---|---|
| 7,715,276 | B2 * | 5/2010 | Agam | B61L 23/041 367/96 |
| 7,770,847 | B1 * | 8/2010 | Severson | A63H 19/24 246/1 C |
| 8,596,587 | B2 * | 12/2013 | Hilleary | B61L 23/041 246/125 |
| 9,019,115 | B2 * | 4/2015 | Ballinger | B61L 29/24 246/292 |
| 2004/0129840 | A1 * | 7/2004 | Horst | B61L 3/127 246/186 |
| 2018/0273062 | A1 * | 9/2018 | Fries | B61L 23/005 |
| 2018/0273067 | A1 * | 9/2018 | Fries | B61L 23/041 |
| 2018/0273069 | A1 * | 9/2018 | Fries | B61L 29/22 |

* cited by examiner

SYSTEM AND METHOD FOR CONTROLLING A LEVEL CROSSING

CROSS-REFERENCE TO RELATED APPLICATIONS

This Application is a Continuation-In-Part of U.S. application Ser. No. 15/466,071 filed Mar. 22, 2017. The entire contents of which are incorporate herein by reference.

FIELD OF THE INVENTION

The present invention relates to a system and a method for controlling a level crossing of a railway track.

BACKGROUND

A level crossing is an intersection where a railway line crosses a road or path at the same level, as opposed to railway line crossings using bridges or tunnels. The safety of level crossings is one of the most important issues of railways services. Each year about 400 people in the European Union and over 300 in the United States are killed in level crossing accidents. Collisions can occur with vehicles as well as pedestrians; pedestrian collisions are more likely to result in death.

As far as warning systems for road users are concerned, standard level crossings have either passive protections in the form of different types of warning signs, or active protections, using automatic warning devices such as flashing lights, warning tones and boom gates. Fewer collisions take place at level crossings with active warning systems.

Recently, railroad companies have started to control level crossings through wireless control systems of the trains (e.g. ITCS, ETCS, I-ETMS etc.), because this approach provides many benefits.

In these systems, a signal is wirelessly sent from a control unit of the train towards a control unit associated to the level crossing, thus allowing the latter to properly control the opening or closing of bars or gates placed in correspondence of the level crossing and arranged to prevent the crossing of the level crossing by vehicles or pedestrians present on the intersecting road or path.

This way of controlling the level crossings allows operations to be performed at speeds higher than the traditional activation through track circuits.

Level crossings operated through track circuits activate the crossing based either on initial occupancy of a section of track, or on detection of motion in any section of a track, or on prediction of arrival time based on changes in the electrical impedance of a track measured between the level crossing and the lead axle of the train.

All these track circuit methods have physical limitations as to how far from the crossing they can detect the train.

If a minimum amount of warning time is required for correctly closing the bars of a level crossing, then there is an upper limit to the maximum speed of the train at which track circuits can effectively and timely provide this warning time.

Wireless activation also enables constant warning prediction in areas where it was not previously possible (e.g. electrified rails, areas of poor shunting, etc.).

In some cases, railroad companies have considered to completely eliminate the activation of level crossing through track circuits and to operate them (namely, the bars present in correspondence of level crossings) through wireless activation only.

In fact, track circuits used to operate the bars represent a big expense for companies as they require constant adjustment and maintenance, and numerous train delays occur due to poor operation in harsh environmental conditions or when the track wires are damaged by the track maintenance equipment.

While the wireless level crossing activation potentially enables the elimination of the track circuits, the island track circuit is still required to keep the bars down when a train occupies a short area of a railway track placed on both side of a road.

In fact, a track circuit controlled level crossing generally has two different track circuits: one approach circuit and one island circuit.

The approach track circuit is a long distance circuit looking for the initial approach of the train, for the purpose of activating the warning devices. Any activation of the warning devices from the approach track circuit may be cleared if the train stops short of the crossing.

The island track circuit is a short distance circuit, that keeps the warning devices activated any time this circuit is occupied by any portion of the train.

The main drawback of these existing circuits is that they require both constant adjustment and maintenance and a wired connection to the rails, which is commonly damaged by track maintenance equipment.

As a result, the train movements are restricted until these wired connections are repaired and the level crossing equipment is tested and restored.

There is therefore the need to replace such island track circuits with a solution that is however capable of providing a SIL-4 (Safety Integrity Level) train detection, with a reliability equivalent to the one of the solution based on the island track circuits but that, on the other side, does not require wires attached to the rails or equipment in the fouling zone wherein a fouling zone is an area where track maintenance equipments may damage devices of the railway track.

SUMMARY

An object of the present invention is therefore to provide a system and a method for controlling a level crossing of a railway track which is capable of detecting the presence of a train on the railway track itself without the need of wires attached to the rails, thus enabling safe operation of bars placed in correspondence of the level crossing by overcoming the limitations of the prior art systems.

This and other objects are achieved by a system for controlling a level crossing of a railway track having the characteristics as defined in the examples below and by a corresponding method having the characteristics defined below, as well.

Particular embodiments of the invention are the subject of the dependent claims, whose content is to be understood as an integral or integrating part of the present description.

BRIEF DESCRIPTION OF THE DRAWINGS

Further characteristics and advantages of the present invention will become apparent from the following description, provided merely by way of a non-limiting example, with reference to the enclosed drawings, in which.

DETAILED DESCRIPTION

Briefly, the system of the present invention comprises a plurality of transceiver and associated reflective targets arranged to exchange signals between each other so as to identify the presence of a train on a railway track.

In particular, the initial activation of the bars of a level crossing, the warning lights and bells are triggered by a traditional track circuit or by a wireless train control systems (e.g. ETCS), but the island track circuit function of keeping the gates down, after initial activation, anytime the island area near the road is occupied by a rail vehicle, is done with the system of the present invention.

Figure 1:
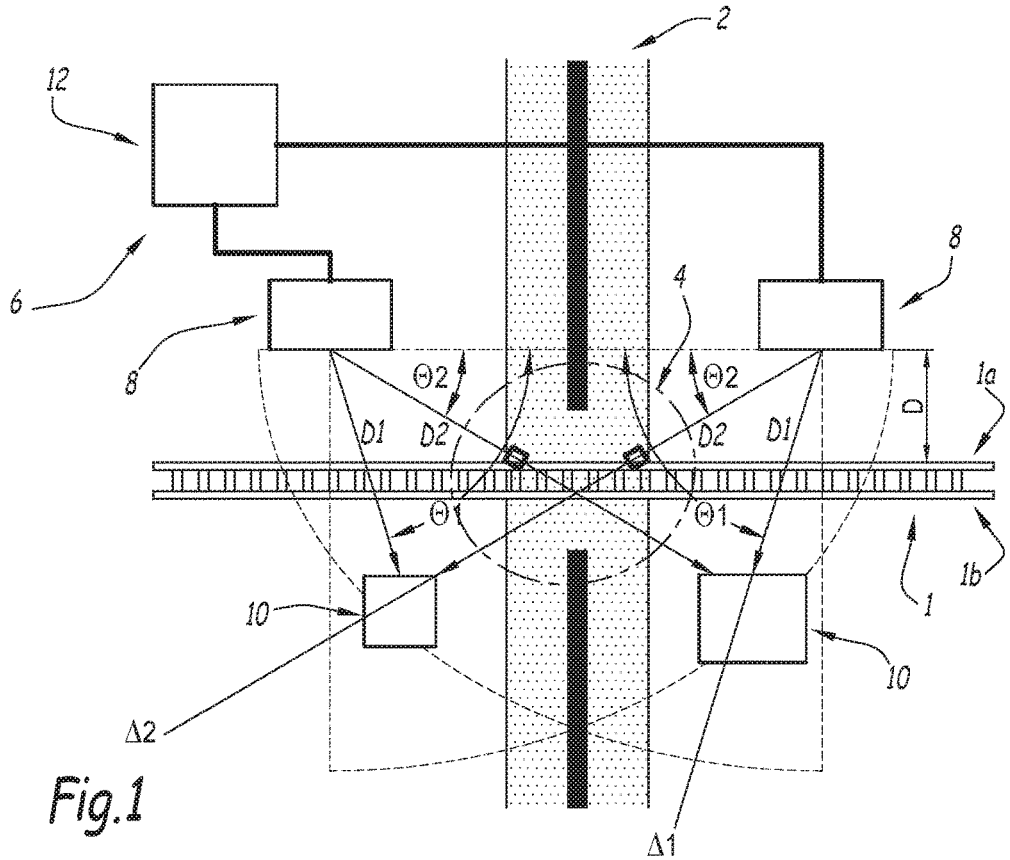
FIG. 1 shows a schematic top view of a level crossing provided with a system for controlling a level crossing according to the present invention.

FIG. 1 shows a schematic top view of a level crossing provided with a system for controlling a level crossing according to the present invention.

In FIG. 1, a railway track is indicated with reference 1; it comprises a first rail 1*a* and a second rail 1*b*.

A road 2 crosses perpendicularly the railway track 1, in a level crossing area 4.

A system for controlling a level crossing 6 comprises two transceivers 8 of radar type, located in proximity of the level crossing area 4 on a first side of the railway track 1, preferably at a distance D ranging from 10 to 50 feet from the first rail 1*a*.

The system for controlling the level crossing 6 comprises also two passive reflective targets 10 of radar type, located in proximity of the level crossing area 4 on a second side of the railway track 1 opposite to the first side where the radar transceivers 8 are located. Distance D is measured perpendicularly to railway track 1.

Advantageously, the radar transceivers 8 are located each on a respective different side of the road 2 and the radar targets 10 are also located each on a respective different side of the road 2.

Each radar transceiver 8 is separated from a corresponding directly opposite radar target 10 by a fist distance $D_1$, preferably ranging from 25 to 100 feet.

Each radar transceiver 8 and the corresponding directly opposite radar target 10 are located on the same side of the road 2.

Each radar transceiver 8 is separated from a corresponding diagonally opposite radar target 10 by a second distance $D_2$, preferably ranging from 50 to 200 feet.

Each radar transceiver 8 and the corresponding diagonally opposite radar target 10 are located on different sides of the road 2.

In an alternative embodiment of the invention, distances D1 and D2 are different for each transceiver 8.

In a yet another alternative embodiment of the invention, the radar transceivers 8 and radar targets 10 may be located on the same or any side of the railway track 1 or road 2.

Advantageously, each transceiver and each target are arranged in order that when a train circulates in an area around the level crossing area, the train disturbs the signals exchanged between each transceiver and each target. In other words, each transceiver and each target are arranged in order that when a train circulates in the area around the level crossing area, the train is positioned between, on one side, each transceiver and, on the other side, each target and the train notably intercepts at least partially a RF signal emitted by each transceiver.

A first angle $\theta_1$ is defined for each radar transceiver 8 between, on the one hand, a horizontal line $\Delta_1$, extending between the radar transceiver 8 and its corresponding directly opposite radar target 10, and, on the other hand, a horizontal line $\Delta$ extending parallel to the railway track between the two radar transceivers 8. A second angle $\theta_2$ is defined for each radar transceiver 8 between, on the one hand, a horizontal line $\Delta_2$ extending between the radar transceiver 8 and its corresponding diagonally opposite radar target 10, and the horizontal line $\Delta$ extending between the two radar transceivers 8. Distance $D_1$ is measured along line $\Delta_1$ whereas distance $D_2$ is measured along line $\Delta_2$.

The radar transceivers 8 and radar targets 10 can be pole mounted outside of the fouling zone of the railway track 1, i.e. attached to a pole if there are no mounting structures already present on the railway track 1.

The radar transceivers 8 are connected to a control unit 12 arranged to acquire measurements from the radar transceivers 8 themselves and to elaborate such measurements so as to detect the presence of a train in an area surrounding the level crossing area 4.

Each radar transceiver 8 is in fact capable of calculating parameters (e.g. distance, angle, size) of both reflective radar targets 10, which are placed so that the transceiver detection of the targets 10 covers an area across the railway track 1 and the road 2 around the level crossing area 4, as shown by the two grey zones on FIG. 1.

Each radar transceiver 8 sends towards both radar targets 10 respective RF signals and receives the corresponding reflected signal. Subsequently, these signals are elaborated, in a manner per se known, by the radar transceivers 8 themselves to calculate parameter whose values are sent back to the control unit 12.

In particular, the parameters calculated by each radar transceiver 8 are the angles $\theta_1$ and $\theta_2$ and the distances $D_1$ and $D_2$.

In an alternative embodiment of the invention, the targets 10 are arranged to reflect a signal whose magnitude is an indication of the size of the targets 10 themselves. The targets 10 have therefore a range of reflected magnitude based on their size, and can even be diverse from each other. With the use of radar targets 10 having different size, therefore with diverse radar cross sectional areas, safety is enhanced.

In a yet another alternative embodiment of the invention, the radar targets 10 may be objects present within the field of view of the radar transceivers 8 (for example, rails, ties, ballast, structures, etc), i.e. in the environment of the radar transceiver and notably in the area around the level crossing area. The distance and/or angles to these objects can be established as fixed parameters to identify if the radar transceivers 8 are operating properly. Each target is, for example, chosen among rails of the railway track, railway ties of the railway track, a ballast receiving the railway track, a train powering system installed along the railway track, an electrical bungalow installed along the railroad track.

These parameters values are sent to the control 12 which compares these values with predetermined corresponding thresholds so as to check whether all these values fall within predefined ranges. Preferably, these ranges vary from 10-20% over a predetermined expected value. If at least one of the above indicate parameter values is not included in its correspondent range, the control unit 12 considers that a train is crossing the level crossing because the level crossing area 4, also known as the "island", is considered occupied. In such a case, control unit 12 sends one or several corresponding signals, in particular a signal for closing the bars of the level crossing.

The above disclosed operations of the system for controlling a level crossing 6 complies with the closed loop fail safety principle required for SIL-4 operation.

In an alternative embodiment of the invention, the function of control unit 12 may be performed inside of each radar transceiver 8. In this alternative, each radar transceiver 8 may comprise a specific control unit which is adapted to calculate and communicate a train presence indicator to a command unit of the level crossing. In this alternative the command unit is adapted to move the bars of the level crossing and notably to close them in function of the train presence indicator communicated by the control units of the radar transceivers 8.

More especially, each specific control unit is arranged to acquire said parameters values from the associated transceiver and to elaborate them so as to detect the presence of a train in an area around the level crossing area and, in case of presence of said train, to send a warning message and/or close bars of the level crossing.

Figure 2:
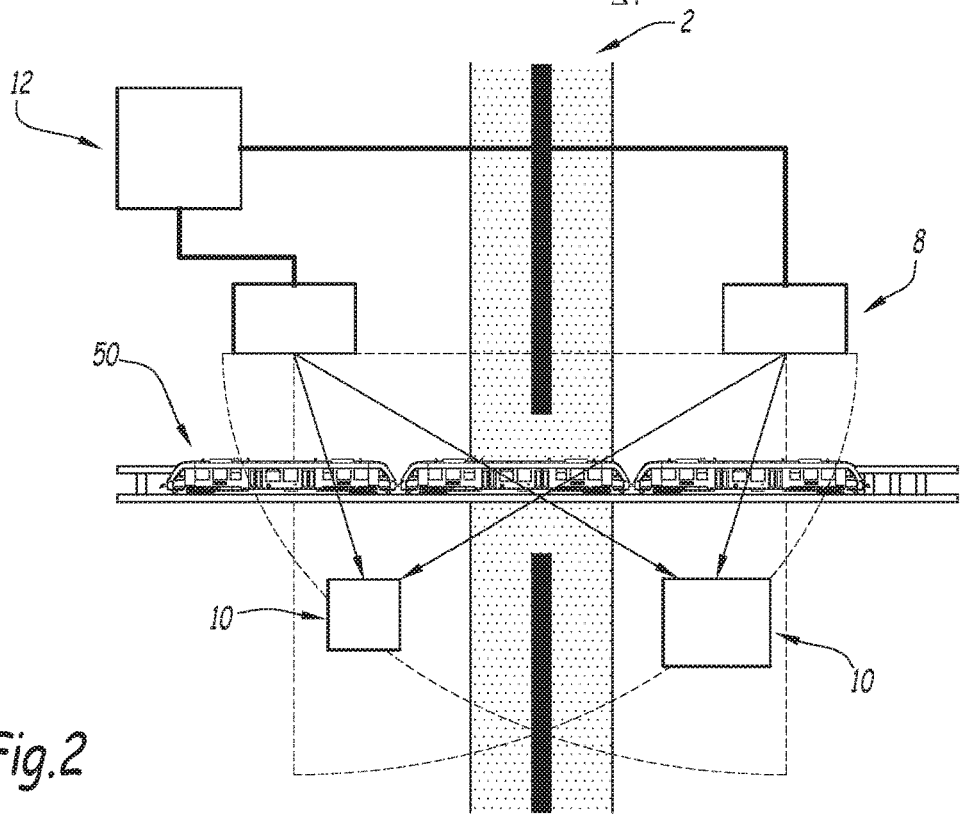
FIG. 2 shows the same schematic view of FIG. 1 with a train present on the railway track.

FIG. 2 shows the same schematic view of FIG. 1 with a train present on the railway track 1.

In FIG. 2 a train 50 is shown on the railway track 1 in the level crossing area 4. In this situation, the radar transceivers 8 have no longer visibility of the radar targets 10 and/or the parameter values do not fall any more within the expected ranges, thus resulting in an "island occupancy" situation detected by control unit 12.

In the above disclosed system, any failure of the radar transceivers 8 and radar targets 10, or any imprecision of their physical alignment, would also result in measurements outside of the ranges, and the control unit 12 would consider these situations as occupancy of the level crossing area 4.

In order to limit the possible influences of any failure of the transceivers 8 on the system of the present invention, in a preferred embodiment, the radar transceivers 8 are only activated when the control unit 12 is aware of an approaching train 50 that has requested wireless level crossing activation. For example, when a train 50 is approaching a level crossing, it automatically sends to the control unit 12 an activation signal, and at this point the control unit 12 starts the acquisition of the parameter values from the radar transceivers 8.

Alternatively, a track circuit is used to detect the approach of the train.

In this way it is possible to avoid detection of occupancy of the level crossing due to objects other than the train (e.g. automobiles, humans, etc.) prior to the crossing activation.

The radar transceivers 8 are connected to the control unit 12 through independent communications channels. If wires are used to connect the radar transceivers 8 to the control unit 12, the wires are only required on the side of the rails 1*a*, 1*b* where the existing crossing bungalow exists, where power is also available for the control unit 12.

As above cited, there are already equipments at the level crossing to actuate the warning devices (gates, lights, bells). The control unit 12 is arranged to manage this wireless crossing activation function or, in an alternative embodiment, it has an output directed towards the existing crossing warning control system.

The bungalow is the structure that houses existing control systems and wherein the control unit 12 can be hosted.

In a preferred embodiment, for increasing the security of the transmissions and for avoiding external noises, the radar transceivers 8 modulate a dynamic code with safety CRC on the RF signal transmitted towards the targets 10, and validate the received RF signal reflected from the target 10 only when it contains an expected checking data.

The control unit 12 performs known safety critical integrity tests on the devices so as to verify that the transmitters 8 and receivers 10 are properly working. Examples of controls are those done on the transmitter gain, receiver gain, ADC integrity, etc.

In the following part of the description, a method for controlling a level crossing according to the present invention will be disclosed in detail.

Figure 3:
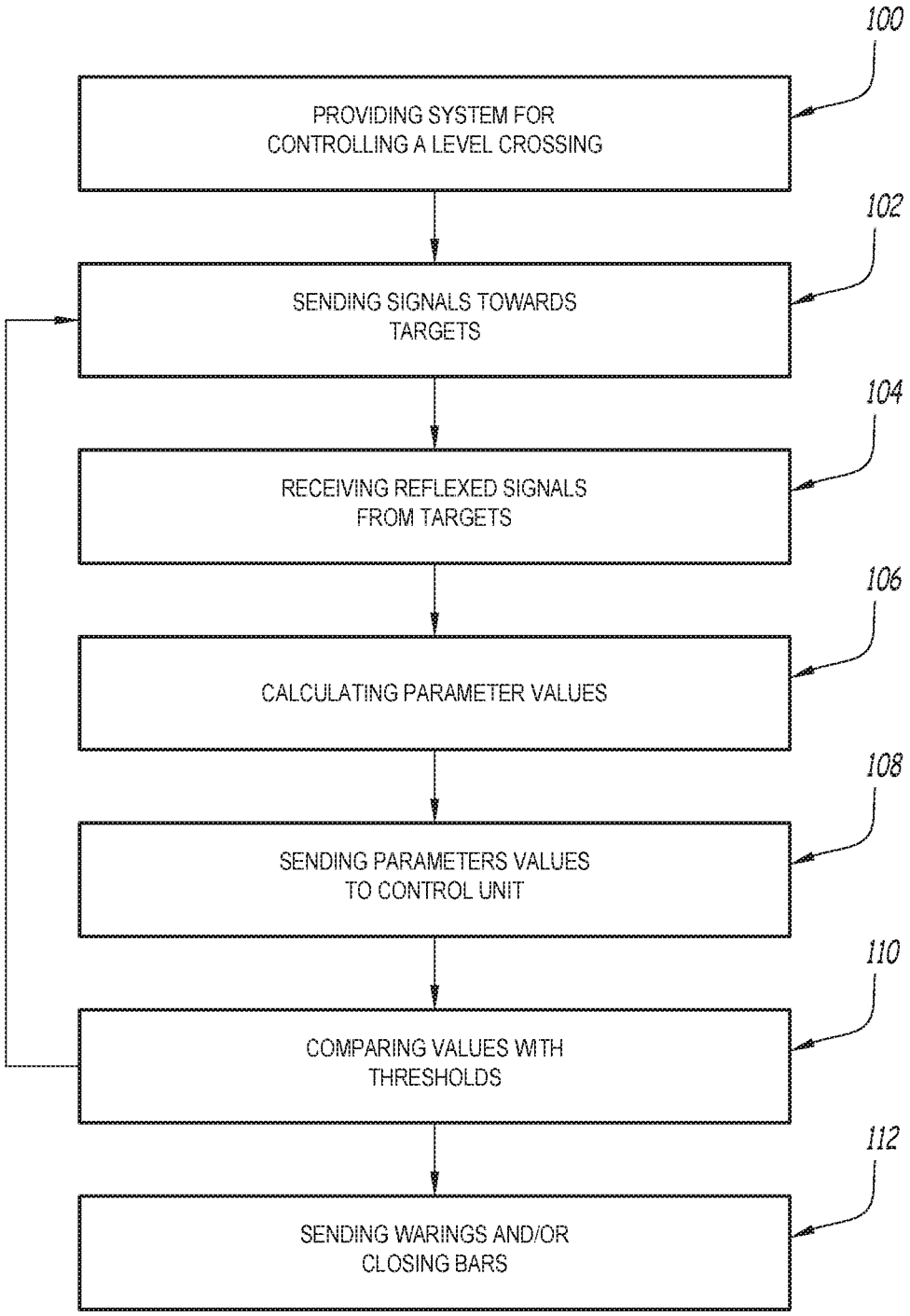
FIG. 3 shows a block diagram of the steps performed by the method for controlling a level crossing according to the present invention.

FIG. 3 shows a block diagram of the steps performed by the method for controlling a level crossing according to the present invention.

In a first step 100, a system for controlling a level crossing 6 of the type above disclosed is provided in correspondence of a level crossing between a railway track 1 and a road or path 2.

Then, in a further step 102, a respective RF signal is sent from each radar transceiver 8 towards both radar targets 10.

In step 104, respective reflected signals coming from the targets 10 are received at each transceiver 8.

Subsequently, at step 106, these signals are elaborated so as to calculate parameters values whose values are sent back, in step 108, to the control unit 12.

Finally, at step 110, the control unit 12 compares these parameter values with predefined thresholds to identify the presence of a train 50 on the railway track 1 in an area surrounding the level crossing area 4.

If the values lie within ranges defined by these thresholds, the control unit 12 considers that no train 50 is detected in the area surrounding the level crossing area 4 and step 102 is implemented again. Otherwise, the control unit 12 considers that a train 50 is detected and implements a further step 112 where it activates the level crossing warning devices (gates, lights, bells, etc.) and advantageously maintains the bars closed while the bars have been closed when the track circuit has detected the approach of the train or the train has sent a message indicating its approach to the control unit 12.

As an alternative, if the level of safety required is less, a single radar transceiver 8 and a single target 10 are used.

Clearly, the principle of the invention remaining the same, the embodiments and the details of production can be varied considerably from what has been described and illustrated purely by way of non-limiting example, without departing from the scope of protection of the present invention as defined by the attached claims.

The invention claimed is:

1. A system for controlling a level crossing associated with a railway track and comprising:

one or more transceivers located in proximity of a level crossing area;

one or more corresponding passive reflective targets located in proximity of the level crossing area;

a control unit connected to each transceiver;

wherein:

each target, which is an object present within the field of view of the radar transceivers, is arranged to receive RF signals coming from each transceiver and to send back corresponding reflected signals;

each transceiver is arranged to elaborate said reflected signals so as to calculate predetermined parameters values;

each transceiver and each target are arranged in order that when a train circulates in an area around the level crossing area, the train disturbs the signals exchanged between each transceiver and each target; and the control unit is arranged to acquire said parameters values from each transceiver and to elaborate them so as to detect the presence of a train in the area around the level crossing area and, in case of presence of said train, to send a warning message and/or close bars of the level crossing.

2. The system according to claim 1, wherein each transceiver is located on a first side of a railway track and each target is located on a second side of the railway track opposite to the first side.

3. The system according to claim 1, wherein each transceiver comprises a specific control unit arranged to acquire said parameters values from the associated transceiver and to elaborate them so as to detect the presence of a train in an area around the level crossing area and, in case of presence of said train, to send a warning message and/or close bars of the level crossing.

4. The system according to claim 1, wherein each target is chosen among rails of the railway track, railway ties of the railway track, a ballast receiving the railway track, a train powering system installed along the railway track, an electrical bungalow installed along the railway track.

5. The system according to claim 1, wherein said parameters values include a first distance between each transceiver and a corresponding first target; a second distance between each transceiver and a corresponding second target; and for each transceiver:

a first angle defined by a horizontal line extending between the transceiver and its corresponding first target and a horizontal line extending parallel to the railway track in the level crossing area; and a second angle defined by a horizontal line extending between the transceiver and its corresponding second target and the horizontal line extending parallel to the railway track in the level crossing area.

6. The system according to claim 2, wherein said parameters values include a first distance between each transceiver and a corresponding directly opposite target; a second distance between each transceiver and a corresponding diagonally opposite target; and for each transceiver:

a first angle defined by a horizontal line extending between the transceiver and its corresponding directly opposite target and a horizontal line extending parallel to the railway track in the level crossing area; and a second angle defined by a horizontal line extending between the transceiver and its corresponding diagonally opposite target and the horizontal line extending parallel to the railway track in the level crossing area.

7. The system according to claim 1, wherein the control unit is arranged to compare the parameters values with predetermined thresholds and, if these values are out of ranges defined by said thresholds, to consider that the presence of a train is detected.

8. The system according to claim 1, wherein each transceiver modulates a dynamic code with safety (CRC) on the RF signal transmitted towards each target, and validates the received RF signal reflected from the target only when it contains an expected checking data.

9. The system according to claim 1, wherein the acquisition of the parameters values from each transceiver is only activated when the control unit receives from the approaching train a corresponding activation signal.

10. The system according to claim 1, wherein each target is arranged to reflect a signal whose magnitude is related the size of the target itself.

11. The system according to claim 1, wherein each target and each transceiver are of radar type.

12. The system according to claim 1, wherein the system comprises two transceivers located in proximity of the level crossing area on a first side of the railway track and two targets located in proximity of the level crossing area on a second side of the railway track opposite to the first side where the transceivers are located.

13. The system according to claim 1, wherein the system comprises two transceivers and two targets located in proximity of the level crossing area.

14. The system of claim 12, wherein transceivers are located each on a respective different side of a road crossing the railway track in the level crossing area and targets are also located each on a respective different side of the road.

15. A method for controlling a level crossing between a railway track and a road comprising the steps of:

sending a respective RF signal from one or more transceivers towards one or more corresponding passive reflective targets, wherein each transceiver is in proximity of a level crossing area, wherein each target is in proximity of the level crossing area, and wherein each target is an object present within a field of view of its corresponding transceiver;

receiving at each transceiver respective reflected signals coming from each target;

elaborating these signals so as to calculate predetermined parameters values;

sending back said parameters values to a control unit;

comparing these parameter values with predefined thresholds to identify the presence of a train on the railway track in an area surrounding the level crossing area; and sending at least one of a warning message and closing bars of the level crossing in case the comparison of the previous step identifies the presence of said train.

* * * * *